US005502896A

United States Patent [19]

Chen

[11] Patent Number: 5,502,896

[45] Date of Patent: Apr. 2, 1996

[54] CUTTER KNIFE

[75] Inventor: Jau Liang Chen, Changhua, Taiwan

[73] Assignee: SDI Corporation, Taiwan

[21] Appl. No.: 439,627

[22] Filed: May 12, 1995

[51] Int. Cl.[6] ..... B26B 1/08

[52] U.S. Cl. ..... 30/162; 30/335

[58] Field of Search ..... 30/162, 151, 329, 30/335, 125

[56] References Cited

U.S. PATENT DOCUMENTS

| | | | |
|---|---|---|---|
| 4,277,888 | 7/1981 | Szabo | 30/162 |
| 4,322,885 | 4/1982 | Osada | 30/162 |
| 5,269,063 | 12/1993 | Okada | 30/162 |

*Primary Examiner*—Hwei-Siu Payer

*Attorney, Agent, or Firm*—Hamilton, Brook, Smith & Reynolds

[57] ABSTRACT

A cutter knife with a detachable blade includes an elongated case slidably receiving a control member which has a blade held thereon in a partial top-opening through space defined in an upper portion thereof and enclosed by an end cap at a tail end thereof. The cutter knife further has a retaining element adapted to hold blades thereon and slidably received in a space defined in a lower portion of the case. The control member includes a spring biased button movably coupled to the base, a resilient latch element on a lateral side thereof for resiliently engaging with a saw-teeth formation formed on the case to serve as an auxiliary locking device, and a spring biased locking element movably retained in the base and actuated by the button to selectively engage with teeth of the saw-teeth formation formed in the case and thereby locking the control member and the blade at a desired position.

5 Claims, 3 Drawing Sheets

CUTTER KNIFE

BACKGROUND OF THE INVENTION

1. Field of the Invention

The present invention relates to a cutter knife with snap-off blade and, more particularly, to a cutter knife having an improved safety feature.

2. Description of Related Art

A cutter knife with a detachable blade has an advantage that only the worn part of the detachable blade needs to be snapped-off instead of throwing away an entire knife in which only a tip portion is usually thereof worn. Therefore, a cutter knife with a detachable blade has become popular in both daily life and special activities, such as, model making. However, owing to the dangerous nature of a knife, safety is still the main concern in using the cutter knife.

Unfortunately, there are not sufficient safety devices provided in a conventional cutter knife. In a conventional cutter knife, the only safety device provided is a resilient engaging element formed on a lateral side of a control element to engage with a saw-teeth formation formed on the cutter knife and thereby holding the blade in a desired position. Yet, since the engaging element and the saw-teeth formation is merely resiliently engaged, the position of the blade will be easily changed, such as from a housed and protected position to an exposed position, when the control element is suddenly subjected to an impact and thus causing injury.

Therefore, there has been a long and unfulfilled need for a cutter knife with detachable blade having a more substantial safety design to prevent accidental injury.

SUMMARY OF THE INVENTION

The present invention provides a cutter knife with a detachable blade which includes:

an elongated case having a first space axially defined in a lower portion thereof with an opening which opens to a second end thereof; a second space axially defined through an upper portion thereof and in communication with the first space; a sliding groove axially defined in a top face thereof and in communication with the second space; and a generally U-shaped guiding element fixedly retained in the second space and having a saw-teeth formation axially constructed along a inward extending flange protruding from a respective vertical wall of the U-shaped guiding element;

a control member slidably received in the guiding element and comprising a holding element formed on a base thereof to hold a blade thereon, a spring biased button movably coupled to the base, and a spring biased locking element movably retained in the base and actuated by the button to selectively engage with teeth of the saw-teeth formation and thereby locking the control member and the blade at a desired position; and an end cap removably coupled to the case at a second end of the case.

In accordance with one aspect of the present invention, the cutter knife further comprises a retaining element having a catching element for holding detachable blades thereon and a pulling portion. The retaining element being slidably received in the first space of the case with the pulling portion remaining outside of the first space such that the blades held thereon are stored in the first space as spare blades.

In accordance with another aspect of the present invention, the base further comprises a resilient latch element on a lateral side thereof for resiliently engaging with the saw-teeth formation to serve as an auxiliary locking device.

In accordance with a further aspect of the present invention, the end cap has a slit defined in an enclosed end thereof to serve as a tool for detaching a worn blade portion of the detachable blade.

In accordance with a further aspect of the present invention, the locking element has a vertical connecting portion contacting the button, two horizontal engaging portions, and a spring loaded portion.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
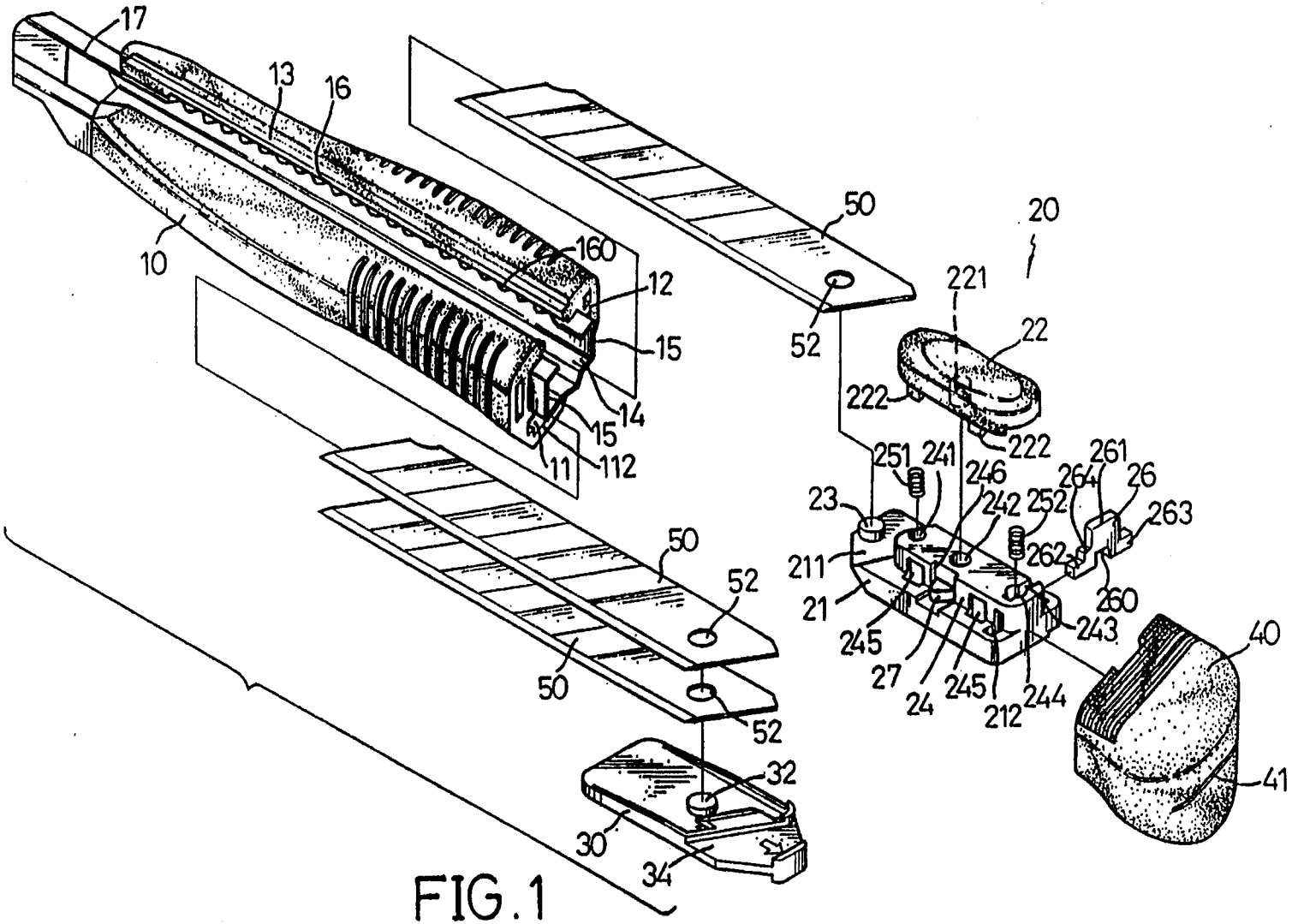
FIG. 1 is an exploded perspective view of a cutter knife in accordance with the present invention.
Figure 2:
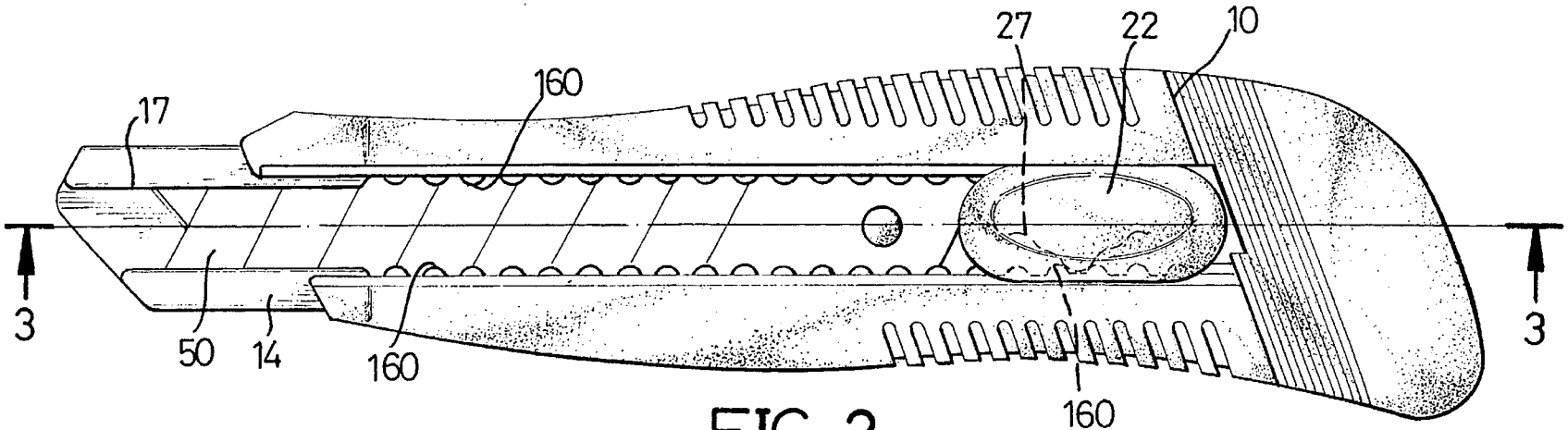
FIG. 2 is a top view of a knife according to the present invention.

Referring to the drawings and initially to FIGS. 1 and 2, a cutter knife in accordance with the present invention generally includes an elongated case member 10, a control member 20, a retaining element 30 and an end cap 40. The case member 10 has a first space 11 defined in a lower portion thereof with an opening 112 open to a second end thereof; a second space 12 defined in an upper portion thereof and in communication with the first space 11; a sliding groove 13 defined in a top face thereof and in communication with the second space 12; and a generally U-shaped guiding element 14 fixedly retained in the second space 12. The guiding element 14 has a pair of opposite vertical side walls 15. Each of the side walls 15 has a flange inwardly extending toward each other thereby defining an axial opening 17 therebetween and a saw-teeth formation 16 is respectively and axially defined therein.

The control member 20 comprises a base 21 and a button 22. The base 21 has a circular peg 23 protruding upwardly from a shallow recess 211 adjacent to a first end thereof to couple a detachable blade 50 thereon by extending the peg 23 through a hole 52 of the detachable blade 50, and a table 24 protruding upwardly from a top face thereof. The table 24 has a hole 241 defined therein adjacent to a first end thereof to partly receive a first spring 251, a positioning hole 242 defined at an intermediate portion thereof, a vertical slot 243 transversely and partly defined therein adjacent to a second end thereof and in communication with a channel 212 defined in the base 21. The slot 243 has an enlarged portion 244 in which a second spring 252 is received, an opening 246 defined in an intermediate section of a side wall thereof which partly receives a folded plate spring 27 inside, and a substantially inverted T-shaped locking plate 26 having a first horizontal wing 262, a second horizontal wing 263, a vertical stem 261 projecting upwardly from a mediate point between the two wings 262, 263, and a notch 260 defined between the first and the second horizontal wings 262, 263 in a lower face thereof and substantially below the vertical stem 261. The locking plate 26 further has a step portion 264 formed between the first horizontal wing 262 and the vertical stem 261 and is retained in the slot 243 with the second spring 252 held in the notch 260. The button 22 is movably mounted on the base 21 by inserting a positioning peg 221 downwardly protruding from a bottom face thereof into the positioning hole 242 and engaging two catches 222 protruding downwardly at one side thereof with two corresponding apertures 245 defined in a lateral side of the table 24.

The retaining element 30 has a peg 32 upwardly formed on a upper face thereof to hold a number of spare detachable blades 50 thereon by extending the peg 32 through a hole 52 of the blades. The end cap 40 has an open space defined therein and a slit 41 defined in an end wall thereof. The end cap 40 is capable of detaching a worn portion of the detachable blade 50 by receiving the worn portion of the blade 50 in the slit 41 and bending the end cap 40 relative to the blade 50.

Figure 3:
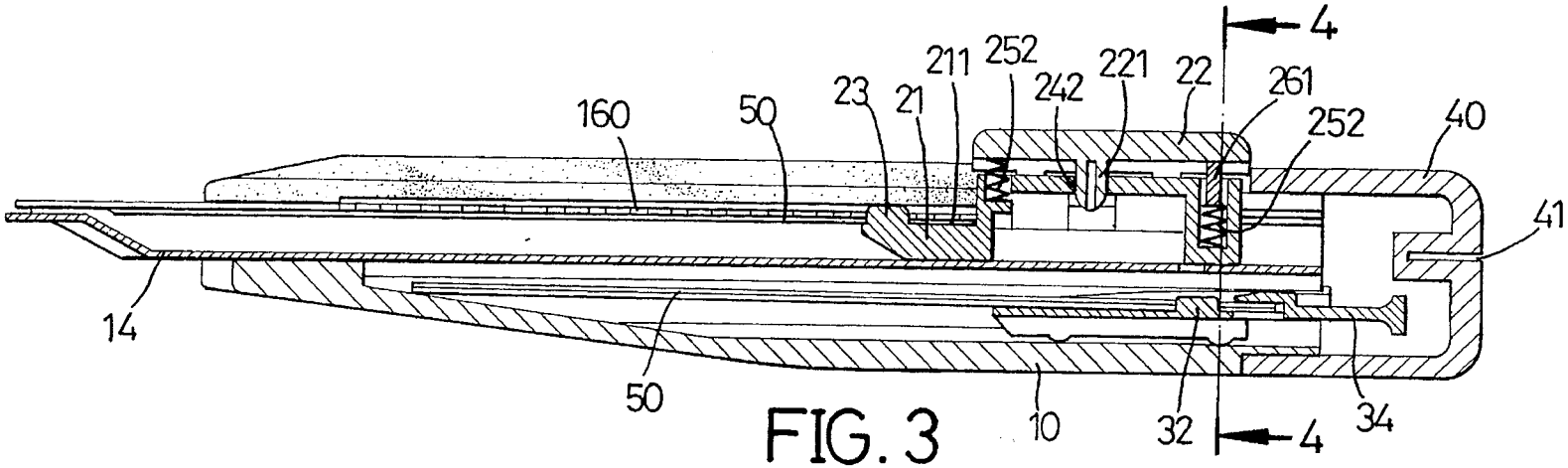
FIG. 3 is a front cross-sectional view taken along line 3—3 of FIG. 2.

In assembly, as better shown in FIG. 3, firstly, the retaining element 30 is slid into the first space 11 of the case 10 from a second end of the case 10 with a pulling portion 34 thereof remaining outside of the case 10. Secondly, the control member 20 is slid into the guiding element 14 with the base 21 thereof retained in the guiding element 14 and the table 24 and the button 22 thereof extending through the axial opening 17 from a second end of the guiding element 14 by pressing down the button 22 to cause the two horizontal wings 262, 263 to be received in the channel 212 of the base 21. Finally, the end cap 40 is coupled to the case 10 at the second end of the case 10 and houses the pull portion 34 of the retaining element 30 therein.

Figure 5:
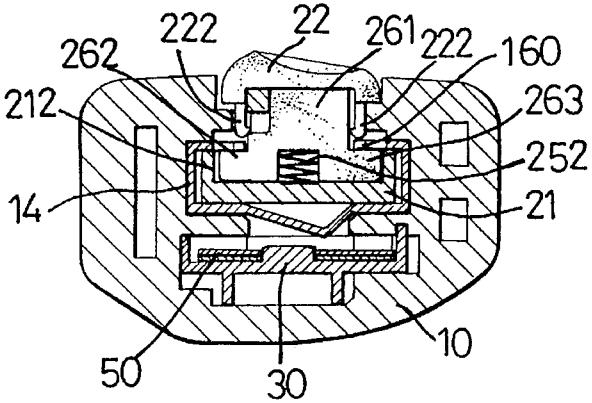
FIG. 5 is a cross-sectional view similar to FIG. 4 showing a released state of the knife.
Figure 4:
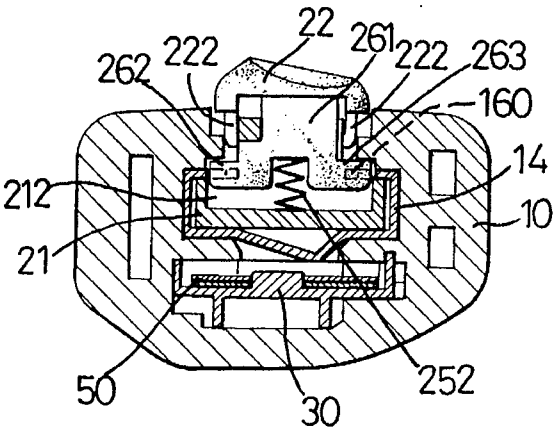
FIG. 4 is a side cross-sectional view taken along line 4—4 of FIG. 3 showing a locked state of the knife.

After the, control member 20 is assembled in the case 10, the folded spring plate 27 engages with one of the saw-teeth formations 16 of the guiding element 14, as shown in FIG. 2, and the button 22 is released such that the locking plate 26 is pushed upward by the second spring 252 and together with the first spring 251 push the button 22 upward, as shown in FIG. 4. As in this state, the two horizontal wings 262, 263 are raised and respectively disposed between adjacent teeth 160 of a respective saw-teeth formation 16 and thereby lock the control member 20 and the detachable blade 50 in position. In order to move the control member 20 and the detachable blade 50 thereon in the case 10, the button 22 is pressed down to cause the two horizontal wings 262, 263 thereby to be pushed down into the channel 212 of the base 21 and disengaged from the saw-teeth formation 16 of the guiding element 14, as shown in FIG. 5.

With the structure as being described hereinbefore, the control member 20 of the cutter knife can withstand a greater blade-cutting force, i.e. a force up to 20 kg, than a conventional cutter knife can to hold the blade 50 in a desired position without accidental sliding.

Although the invention has been explained in relation to its preferred embodiment, it is to be understood that many other possible modifications and variations can be made without departing from the spirit and scope of the invention as hereinafter claimed.

I claim:

1. A cutter knife with detachable blades comprising:

an elongated case having a first space axially defined in a lower portion thereof with an opening open to first end thereof; a second space axially defined through an upper portion thereof and in communication with the first space; a sliding groove defined in a top face thereof and in communication with the second space; and a generally U-shaped guiding element fixedly retained in the second space and having a saw-teeth formation axially constructed along an inward extending flange protruding from a respective vertical wall of the U-shaped guiding element;

a control member slidably received in the guiding element and comprising a holding element formed on a base thereof to hold a blade thereon, a spring biased button movably coupled to the base, and a spring biased locking element movably retained in the base and actuated by the button to selectively engage with the teeth of the saw-teeth formation and thereby lock the control member and the blade at a desired position; and an end cap removably coupled to the case at the first end of the case.

2. The cutter knife as claimed in claim 1 further comprising a retaining element having a catching element for holding detachable blades thereon and a pulling portion, the retaining element being slidably received in the first space of the case with the pulling portion remaining outside of the first space such that the blades held thereon are stored in the first space as spare blades.

3. The cutter knife as claimed in claim 1 wherein the base further comprises a resilient latch element on a lateral side thereof for resiliently engaging with the saw-teeth formation to serve as an auxiliary locking device.

4. The cutter knife as claimed in claim 1 wherein the end cap has a slit defined in an enclosed end thereof to serve as a tool for detaching a worn blade portion of the blade.

5. The cutter knife as claimed in claim 1 wherein the locking element has a vertical connecting portion contacting the button, two horizontal engaging portions, and a spring loaded portion.

* * * * *